US006419227B1

(12) United States Patent
Barnhardt

(10) Patent No.: US 6,419,227 B1
(45) Date of Patent: Jul. 16, 2002

(54) METHOD AND APPARATUS FOR PLAYING A SIMULATED BASEBALL GAME

(76) Inventor: Thomas W. Barnhardt, 3238 Spring Meadow La., Grand Prairie, TX (US) 75052

( * ) Notice: Subject to any disclaimer, the term of this patent is extended or adjusted under 35 U.S.C. 154(b) by 26 days.

(21) Appl. No.: 09/612,085

(22) Filed: Jul. 7, 2000

(51) Int. Cl.[7] ..... A63F 3/00
(52) U.S. Cl. ..... 273/236; 273/244.1; 273/244.2
(58) Field of Search ..... 273/236, 244.1, 273/244.2

(56) References Cited

U.S. PATENT DOCUMENTS

| | | | | | |
|---|---|---|---|---|---|
| 203,368 | A | * | 5/1878 | Peirce | 273/93 |
| 726,062 | A | * | 4/1903 | Honeck | 273/93 |
| 950,810 | A | * | 3/1910 | Watterson | 273/244.1 |
| 1,039,500 | A | * | 9/1912 | Droste | 273/244.1 |
| 1,084,618 | A | | 1/1914 | Elliott | |
| 1,113,504 | A | * | 10/1914 | Steele | 273/244.1 |
| 1,349,190 | A | * | 8/1920 | Duncan | 273/244.1 |
| 1,361,616 | A | * | 12/1920 | Reeves | 273/244.1 |
| 1,525,499 | A | * | 2/1925 | Evans | 273/244.1 |
| 1,536,639 | A | * | 5/1925 | Van Beek | 273/244.1 |
| 1,544,308 | A | * | 6/1925 | Gelpi | 273/244.1 |
| 1,522,617 | A | * | 9/1925 | Kisor | 273/244.1 |
| 1,684,189 | A | | 9/1928 | Meyer | |
| 1,741,596 | A | * | 12/1929 | Wright | 273/93 |
| 2,528,029 | A | * | 10/1950 | Brown | 273/93 |
| 2,727,742 | A | * | 12/1955 | Madsen | 273/93 |
| 2,918,730 | A | * | 12/1959 | Schrade | 35/23 |
| 2,933,316 | A | * | 4/1960 | Mancini | 273/93 |
| 3,124,356 | A | * | 3/1964 | Chordas | 273/93 |
| 3,224,772 | A | * | 12/1965 | Wells et al. | 273/93 |
| 3,224,773 | A | * | 12/1965 | Roed | 273/93 |
| 3,372,933 | A | * | 3/1968 | Murzyn | 273/88 |
| 3,715,124 | A | * | 2/1973 | Swartz | 273/93 R |
| 3,972,530 | A | * | 8/1976 | Dohn | 273/88 |
| 4,244,571 | A | * | 1/1981 | Haglof | 273/93 R |
| 4,261,569 | A | * | 4/1981 | Frohlich | 273/93 C |
| 4,378,115 | A | * | 3/1983 | Terrero | 273/93 C |
| 4,653,755 | A | * | 3/1987 | Panella et al. | 273/93 R |
| 4,708,344 | A | * | 11/1987 | Wyatt | 273/93 R |
| 5,129,651 | A | | 7/1992 | Tobias, Jr. | |
| D389,196 | S | | 1/1998 | Brezny | |
| 5,884,914 | A | * | 3/1999 | Lilien | 273/244.1 |

* cited by examiner

*Primary Examiner*—Benjamin H. Layno
*Assistant Examiner*—Dolores R. Collins

(57) ABSTRACT

A method and apparatus for playing a simulated baseball game for teaching the strategy and for simulating the activity of a baseball game. The method and apparatus for playing a simulated baseball game includes a game board. The game board has a baseball diamond thereon. A scorecard has a matrix thereon. The matrix has heading indicia thereon. A plurality of game pieces are used. A portion of the game pieces is colored red, and a portion of the game pieces is colored white, wherein the red game pieces define fast runners and wherein the white game pieces define power hitters. A chance means motivates actions of the competing players. The chance means provides a two digit number. An outcome portion has means thereon for denoting plays and progress of play according to an outcome of the chance means. An asterisk represents an outcome for a fast runner and a letter P represents an outcome for a power hitter.

3 Claims, 4 Drawing Sheets

26

| DICE ROLL | PITCHER THROWS | BATTER SWINGS | BASES EMPTY | MAN ON 1ST BASE | MAN ON 2ND BASE | MAN ON 3ND BASE | MAN ON 1ST & 2ND | MAN ON 1ST & 3RD |
|---|---|---|---|---|---|---|---|---|
| 11 | Strike | Misses | Homerun | 1st & 2nd* Single-CF | 1 Run Single-LF | P-Sac.Fly FlyOut-RF | Three Run HomeRun | 1st runnr hold Sac.Fly-CF |
| 12 | Ball | Hits | Single-CF | FlyOut-CF | 1st & 3rd Error-SS | 1 Run Single-LF | FlyOut-LF | 1Run,1st&2nd Single-RF |
| 13 | Over | Hits | FlyOut-LF | 1st & 3rd Single-RF | FlyOut-LF | PopOut-2B | 1 Run,1st&2* Single-RF | Bases Loaded Inf. Single |
| 14 | Ball | Foul | GrdOut-2B | FlyOut-1B | FlyOut-2B | 1 Run Inf. Single | 3b-2b Double-Play | SS-2B-1B Double-Play |
| 15 | Over | Foul | GrdOut-3B | 2B-SS Force-Play | Runner to 3rd GroundOut-2B | no run GroundOut-3B | FlyOut-CF | 1 Run Sac.Fly-CF |
| 16 | Strike | Hits | Single-LF | 1st & 2nd Single | GroundOut-1B | 1 Run Single | PopOut-3B | Three Run HomeRun |
| 22 | Ball | Misses | Double-RC | 1 Run Double | Double-Play | Balk | 1 Run,2nd&3 Double | FlyOut-SS |
| 23 | Over | Hits | Single | ss-2b-1b* Double-Play | PopOut-3B | FlyOut-SS | ss-2b-1b Double-Play | 3b-c,1st&2nd Fieldrs Choice |
| 24 | Over | Hits | PopOut-SS | FlyOut-LF | Inf.Single | FlyOut-1B | bases loaded Inf.Single | FlyOut-CF |
| 25 | Over | Hits | FlyOut-CF | 3b-2b Force-Play | Single | Two Run HomeRun | bases loaded Bunt Single | FlyOut-LF |
| 26 | Strike | Hits | FlyOut-RF | Popout-3B | FlyOut-RF | RF-C Double-Play | FlyOut-RF | FoulOut-C |
| 33 | Ball | Misses | Triple | 1 Run Double | Triple | 1 Run Sac. Fly-LF | 1Run,2nd&3* Double | 1Run,2nd&3* Double |
| 34 | Strike | Hits | FlyOut-CF | PopOut-SS | GroundOut-3B | FlyOut-RF | FoulOut-1B | FlyOut-1B |
| 35 | Over | p-miss Foul | GrdOut-3B | 2b-s-1b Double-Play | FoulOut-1B | 1 Run Error-1B | runrs advance GroundOut-2B | FlyOut-RF |
| 36 | Over | Foul | GrdOut-P | runr to 2nd Groundout-1B | FoulOut-3B | no run GroundOut-SS | 3b-2b-1b Double-Play | PopOut-1B |
| 44 | Strike | Misses | Single | 1st & 2nd* Single | FlyOut-CF | 1 Run Double | P-Homerun Flyout-RF | 2 Runs Double |
| 45 | Over | Hits | FoulOut-C | runr to 2nd Groundout-2B | 1 Run Double | no run GroundOut-3B | PopOut-3B | 2 Runs Triple |
| 46 | Over | Hits | GrdOut-1B | FlyOut-CF | runr holds GroundOut-SS | PopOut-3B | 2 Runs Triple | No Run, 2&3 GroundOut-P |
| 55 | Ball | p-miss Foul | Double | 1 Run Triple | P-double Single | 1 run Single* | FlyOut-SS | 1Run,1st&3 Single |
| 56 | Over | Hits | GrdOut-SS | FlyOut-RF | FlyOut-1B | FlyOut-LF | 1 Run,1st&2 Single | FlyOut-2B |
| 66 | Ball | Misses | Single* | Two Run HomeRun | Two Run HomeRun | Sac.Fly-RF | Three Run HomeRun | FlyOut-3B |

FIG. 2A

26

| DICE ROLL | STEAL 2ND | STEAL 3RD | STEAL HOME | BUNT SACRIFICE | HIT & RUN | MAN ON 2ND & 3RD | BASES LOADED | ADV.FAST RUNNERS |
|---|---|---|---|---|---|---|---|---|
| 11 | Out* | Safe | Out | No Good | PopOut | 2 Runs Double | P-Homerun FoulOut-LF | Safe |
| 12 | Error C Out* | Out* | Out | FoulOut-C | 1st & 3rd Single | 1 Run Sac.Fly-CF | 2 Runs,1st&2 Single | Safe |
| 13 | Error 2B | Out | Out | Good | FlyOut | PopOut-C | FlyOut-SS | Out |
| 14 | Out | Safe | Out | Good | 1st & 2nd Error-2B | 1 Run,1st&3 Inf.Single | PopOut-3B | Safe |
| 15 | Out | Out | Out* | No Good | 2B-1B Double-Play | FlyOut-LF | Tape Measure HomeRun | Out |
| 16 | Safe | Out* | Out | Good | PopOut-3B | PopOut-SS | PopOut-1B | Safe |
| 22 | Safe | Out | Safe | P-1B Double-Play | FlyOut-SS | Homerun | 2 Runs,2&3 Double | Out |
| 23 | Out | Safe | Out | Good | 1 Run Double | PopOut-C | 3B-2B-1B Double-Play | Safe |
| 24 | Safe | Out* | Out | 1st & 2nd Error-P | 1st & 3rd Single | PopOut-3B | 1 Run Inf.Single | Out |
| 25 | Safe | Out | Out | Bunt Single | PopOut-SS | P-Homerun Flyout-CF | 1 Run,1st&2 Sac.Fly-LF | Safe |
| 26 | Out | Out | Out* | Good | runr advance GroundOut-2B | FlyOut-RF | FlyOut-SS | Out |
| 33 | Out* | Error 3B | Out | No Good | FlyOut-LF | RF-C Double-Play | PopOut-C | Out |
| 34 | Safe | Out | Out | Good | 2nd & 3rd* Double | Bases Loaded Error-1B | 1 Run Inf.Single | Safe |
| 35 | Safe | Out | Out | Good | 1st & 3rd Single | 1 Run GroundOut-2B | 2B-SS-1B Double-Play | Out |
| 36 | Out | Safe | Out | Good | 1 Run Triple | FlyOut-2B | 3 Runs Triple | Safe |
| 44 | Error C | Out | Out | No Good | Lineout 1B Double-Play | Single | FlyOut | Out |
| 45 | Out | Out* | Out | Good | FlyOut-CF | FlyOut-LF | 1 Run Sac.Fly | Safe |
| 46 | Out | Safe | Out | Bunt Single | 1st & 2nd Inf.Single | FlyOut-1B | FlyOut-RF | Out |
| 55 | Safe | Out | Out | PopOut-P | FlyOut-CF | 3 Runs Triple | Gland Slam HomeRun | Out |
| 56 | Error 2B Out* | Out* | Out | Good | 1st & 2nd* Single-CF | PopOut-SS | FlyOut-3B | Safe |
| 66 | Out* | Safe | Safe | No Good | Flyout-RF | Bases Loaded Inf.Single | 3B-C-1B Double-Play | Safe |

FIG. 2B

METHOD AND APPARATUS FOR PLAYING A SIMULATED BASEBALL GAME

BACKGROUND OF THE INVENTION

1. Field of the Invention

The present invention relates to games and more particularly pertains to a new method and apparatus for playing a simulated baseball game for teaching the strategy and for simulating the activity of a baseball game.

2. Description of the Prior Art

The use of games is known in the prior art. More specifically, games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,129,651; U.S. Pat. No. 4,244,571; U.S. Pat. No. 1,084,618; U.S. Pat. No. 1,684,189; U.S. Des. Pat. No. 3899,196; and U.S. Pat. No. 4,708,344.

While these devices fulfill their respective, particular objectives and requirements, the aforementioned patents do not disclose a new method and apparatus for playing a simulated baseball game. The inventive device includes a game board. The game board has a baseball diamond thereon. A scorecard has a matrix thereon. The matrix has heading indicia thereon. A plurality of game pieces are used. A portion of the game pieces is colored red, and a portion of the game pieces is colored white, wherein the red game pieces define fast runners and wherein the white game pieces define power hitters. A chance means motivates actions of the competing players. The chance means provides a two digit number. An outcome portion has means thereon for denoting plays and progress of play according to an outcome of the chance means. An asterisk represents an outcome for a fast runner and a letter P represents an outcome for a power hitter.

In these respects, the method and apparatus for playing a simulated baseball game according to the present invention substantially departs from the conventional concepts and designs of the prior art, and in so doing provides an apparatus primarily developed for the purpose of teaching the strategy and for simulating the activity of a baseball game.

SUMMARY OF THE INVENTION

In view of the foregoing disadvantages inherent in the known types of games now present in the prior art, the present invention provides a new method and apparatus for playing a simulated baseball game construction wherein the same can be utilized for teaching the strategy and for simulating the activity of a baseball game.

The general purpose of the present invention, which will be described subsequently in greater detail, is to provide a new method and apparatus for playing a simulated baseball game apparatus and method which has many of the advantages of the games mentioned heretofore and many novel features that result in a new method and apparatus for playing a simulated baseball game which is not anticipated, rendered obvious, suggested, or even implied by any of the prior art games, either alone or in any combination thereof.

To attain this, the present invention generally comprises a game board. The game board has a baseball diamond thereon. A scorecard has a matrix thereon. The matrix has heading indicia thereon. A plurality of game pieces are used. A portion of the game pieces is colored red, and a portion of the game pieces is colored white, wherein the red game pieces define fast runners and wherein the white game pieces define power hitters. A chance means motivates actions of the competing players. The chance means provides a two digit number. An outcome portion has means thereon for denoting plays and progress of play according to an outcome of the chance means. An asterisk represents an outcome for a fast runner and a letter P represents an outcome for a power hitter.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as no including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new method and apparatus for playing a simulated baseball game apparatus and method which has many of the advantages of the games mentioned heretofore and many novel features that result in a new method and apparatus for playing a simulated baseball game which is not anticipated, rendered obvious, suggested, or even implied by any of the prior art games, either alone or in any combination thereof.

It is another object of the present invention to provide a new method and apparatus for playing a simulated baseball game which may be easily and efficiently manufactured and marketed.

It is a further object of the present invention to provide a new method and apparatus for playing a simulated baseball game which is of a durable and reliable construction.

An even further object of the present invention is to provide a new method and apparatus for playing a simulated baseball game which is susceptible of a low cost of manufacture with regard to both materials and labor, and which accordingly is then susceptible of low prices of sale to the consuming public, thereby making such method and apparatus for playing a simulated baseball game economically available to the buying public.

Still yet another object of the present invention is to provide a new method and apparatus for playing a simulated baseball game which provides in the apparatuses and methods of the prior art some of the advantages thereof, while simultaneously overcoming some of the disadvantages normally associated therewith.

Still another object of the present invention is to provide a new method and apparatus for playing a simulated baseball game for teaching the strategy and for simulating the activity of a baseball game.

Yet another object of the present invention is to provide a new method and apparatus for playing a simulated baseball game which includes a game board. The game board has a baseball diamond thereon. A scorecard has a matrix thereon. The matrix has heading indicia thereon. A plurality of game pieces are used. A portion of the game pieces is colored red, and a portion of the game pieces is colored white, wherein the red game pieces define fast runners and wherein the white game pieces define power hitters. A chance means motivates actions of the competing players. The chance means provides a two digit number. An outcome portion has means thereon for denoting plays and progress of play according to an outcome of the chance means. An asterisk represents an outcome for a fast runner and a letter P represents an outcome for a power hitter.

Still yet another object of the present invention is to provide a new method and apparatus for playing a simulated baseball game that emulates a real baseball game using a chance means for determining outcomes relative to odds for those outcomes as found in a real baseball game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2A is a schematic plan view of one-half of the outcome portion of the present invention.

FIG. 2B is a schematic plan view of one-half of the outcome portion of the present invention.

DESCRIPTION OF THE PREFERRED EMBODIMENT

Figure 1:
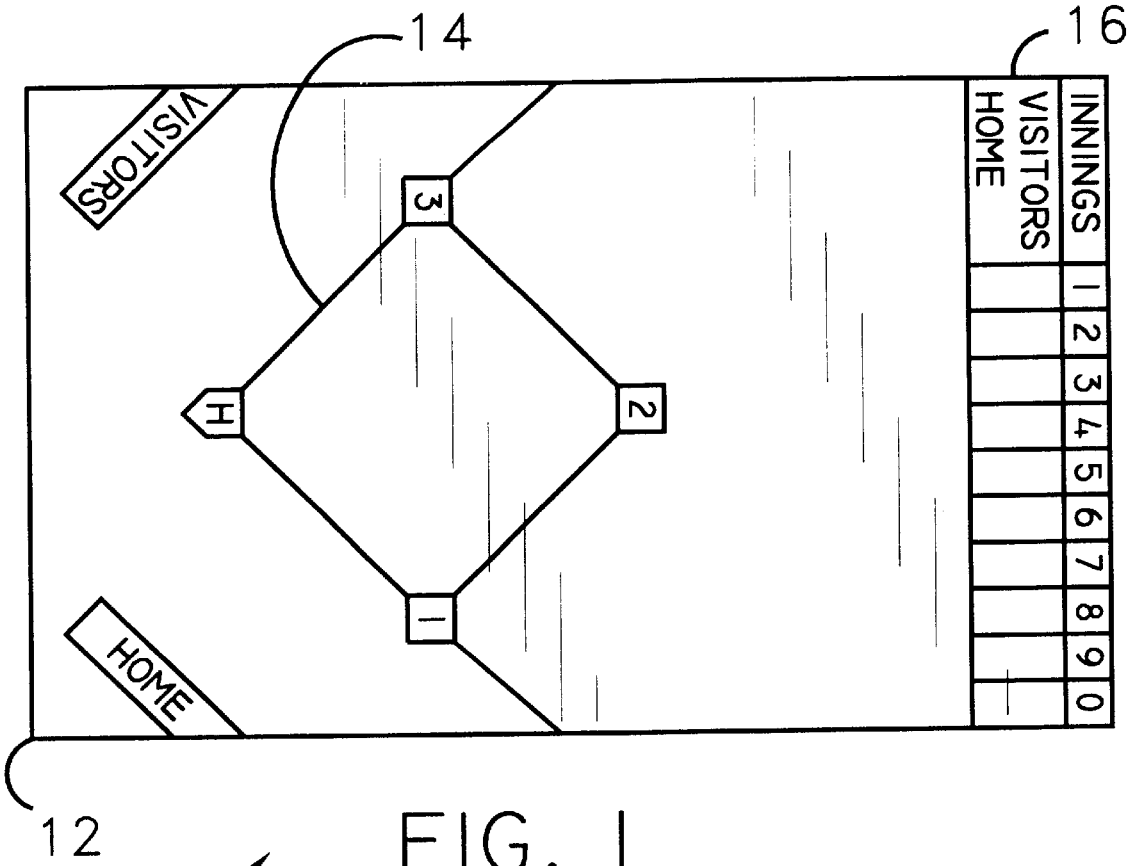
FIG. 1 is a schematic plan view of the game board of a new method and apparatus for playing a simulated baseball game according to the present invention.
Figure 2:
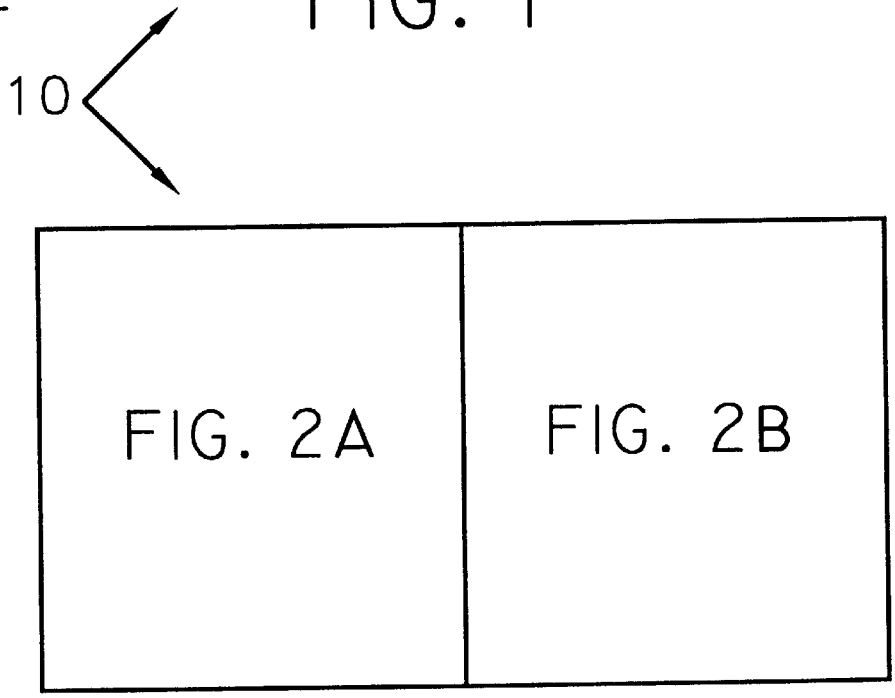
FIG. 2 is a schematic plan view of the relative positioning of FIGS. 2A and 2B of the present invention.
Figure 3:
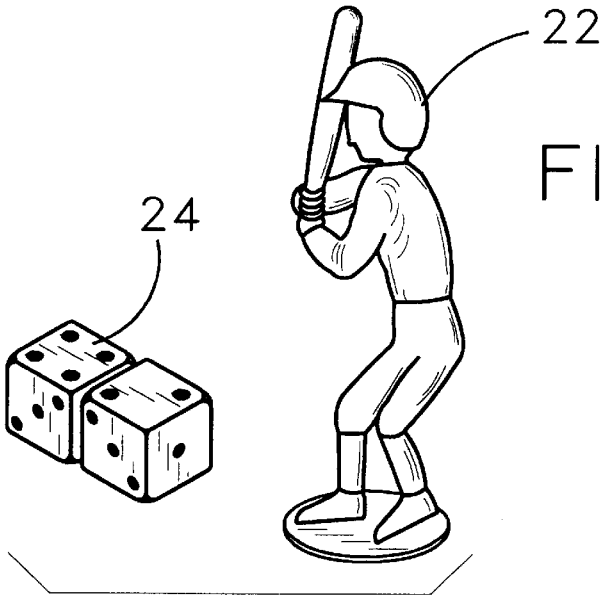
FIG. 3 is a schematic perspective view of the dice and game pieces of the present invention.
Figure 4:
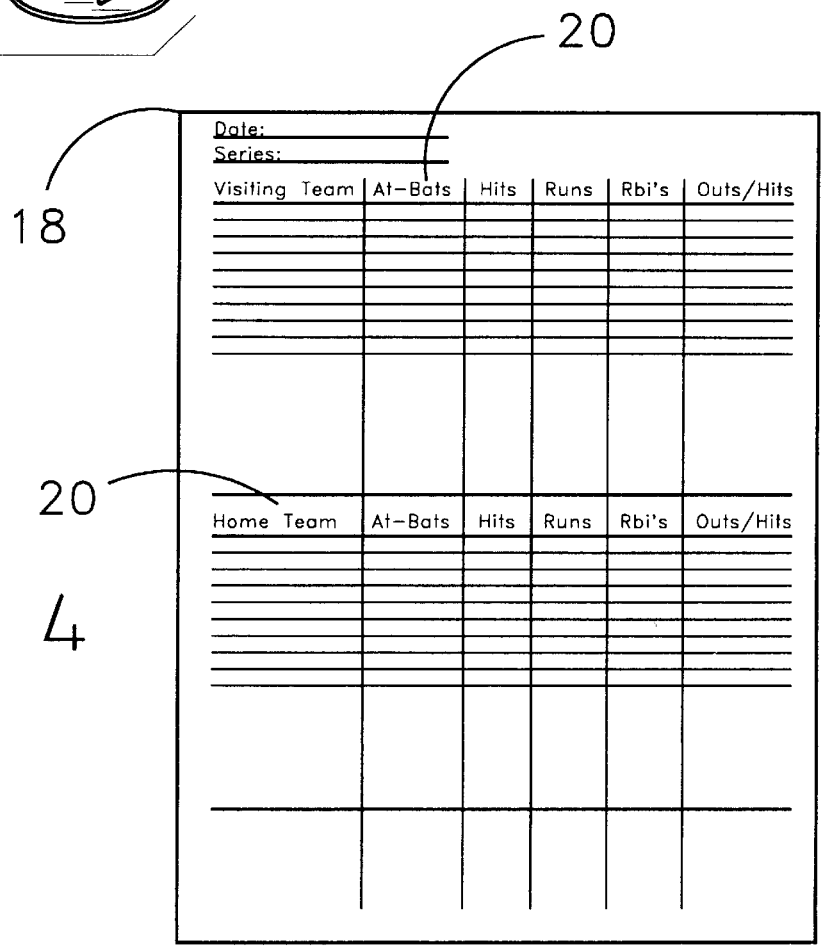
FIG. 4 is a schematic plan view of the scorecard of the present invention.

With reference now to the drawings, and in particular to FIGS. 1 through 4 thereof, a new method and apparatus for playing a simulated baseball game embodying the principles and concepts of the present invention and generally designated by the reference numeral 10 will be described.

As best illustrated in FIGS. 1 through 4, the method and apparatus for playing a simulated baseball game 10 generally comprises a game board 12. The game board has a baseball diamond 14 thereon. The game board 12 has scoreboard indicia 16 thereon indicating runs scored for each inning.

A scorecard 18 has a matrix thereon. The matrix has a series of columns and rows. Each of the columns of the matrix has heading indicia thereon 20. The heading indicia 20 includes at bats, hits, runs, rbi's (runs batted in) and outs/hits. To the left of the heading indicia are columns for writing the line up of each of the teams.

A plurality of game pieces 22 each preferably resembles a baseball player. A portion of the game pieces are colored red, and a portion of the game pieces is colored white. The red game pieces define fast runners, and the white game pieces define power hitters.

A chance means 24 motivates actions of competing players. The chance means 24 randomly provides a two digit number. The chance means 24 are preferably two six-side dice.

An outcome portion 26 has means thereon for denoting plays and progress of play according to an outcome of the chance means. The outcome portions are depicted in FIGS. 2A and 2B and denote every possible play for the game. An asterisk represents an outcome for a fast runner, and a letter P represents an outcome for a power hitter. If a player chooses to use a power hitter or fast runner, the associated outcome of the chance means may change as according to the outcome portion.

In general, the game is played by each player taking an alternate turn electing a play from among the plays available in light of the positions of the playing pieces on the game board, utilizing the chance means to generate a movement determinant according to the outcome portion, and receiving a benefit or detriment according to the outcome portion.

The player who, as in American baseball, has a greater accumulation of runs at a conclusion of the simulated baseball game wins the game.

Game Rules

Number of Players 1–4

Each player prepares a batting lineup of 9 players which includes defense positioning. Each team will have a Pitcher, Catcher, 1st Baseman, Shortstop, 3rd Baseman, Left Fielder, Center Fielder, Right Fielder. Designated Hitters can also be used instead of letting the pitcher bat. Each team is limited to 25 players.

After the lineups are prepared, each team is permitted to have 4 fast runners and 3 power hitters. Identify the player in the batting order that is a fast runner with an asterisk (*). Identify the power hitters with a (P). A player can both be a power hitter and fast runner.

Every position on the baseball field has an abbreviation as listed below. Use these designations when formulating the batting line-up.

| | |
|---|---|
| P = Pitcher | C = Catcher |
| 1B = 1st Baseman | 2B = 2nd Baseman |
| 3B = 3rd Baseman | SS = Shortstop |
| LF = Left Field | CF = Center Fielder |
| RF = Right Field | PH = Pinch Hitter |
| RP = Relief Pitcher | PR = Pinch Runner |
| DH = Designated Hitter | |

The dice are rolled to determine Home Team. The highest number can choose whether to be the home team or the visiting team. The players determine who will keep score. Each player can keep his own score sheet or one player can keep score for both teams.

The rules are generally those of American baseball and are summarized as follows:

4 balls per batter=Walk to $1^{st}$;

3 strikes per batter=Strike Out;

3 Out per inning per batting team.

Games will last usually nine innings but the number of innings can be chosen by the players for expedited play.

The visiting team will bat first and the home team will be pitching; The pitching team rolls first and looks at the outcome portion to determine whether the pitch was a ball, strike or over the plate. This is repeated until the batter strikes out, walks or hits the ball.

The batting team rolls the dice to swing the bat if the outcome of the pitch is over the plate. The batter will miss the pitch, foul the pitch or hit the ball. If the batter swings and misses the pitch it is counted as a strike. If it is the third strike on the batter, the batter is out. If the batter swings and fouls off the pitch, it is also counted as a strike. A foul ball will never count as a third strike unless the batter is attempting to bunt. If the batter hits the ball, the batting team will then pick up the dice and roll again to determine the result of the at-bat. Each column of the outcome portion is marked to determine the base runner situation when the batter hits the ball.

EXAMPLE

Both players have prepared their batting line up cards. To determine home team both players roll one die, the first team rolls a 5 and the second team rolls a 3. The first team won the roll and decides to be home team.

First Team Pitching:

| Rolls | Result | Count on batter |
|---|---|---|
| 61 = 16 | Strike | 0-1, 0 Balls and 1 Strike on Batter |
| 12 = 12 | Ball | 1-1, 1 Ball and 1 Strike on Batter |
| 41 = 14 | Ball | 2-1, 2 Balls and 1 Strike on Batter |
| 45 = 45 | Over | It is over the plate |

In this example, the first team rolls 2 dice, the first roll is a 6 and a 1. The lowest numbered die is always first so the number 16 is looked at under the pitcher throws column of the outcome portion to find strike. So we look at 16 under the pitcher column which is a STRIKE one on the batter.

Second Team Batting:

| Rolls | Result |
|---|---|
| 25 = | Hits, the batter hits the ball, pick up dice and roll again |
| 11 = | Home Run |

The second team then rolls 2 dice to determine whether or not the ball was hit. The second team rolls a 2 and a 5, which is 25 and equates to the batter hitting the ball. The second team then rolls again to determine the result of the hit. Since, as of yet, no other game pieces are on base, the second player will look under the bases empty column of the outcome portion. The second team rolls a 1 and a 1 for an 11 which is a home run.

The first team will continue to pitch until three outs are made.

Using the score card should be completed in the following manner:

| | | |
|---|---|---|
| K = Strikeout | FO = Fly Out | E = Error |
| W = Walk | GO = Ground Out | S = Single |

-continued

| | | |
|---|---|---|
| SF = Sacrifice Fly | D = Double | DP = Double Play |
| T = Triple | PO = Pop Out | HR = Home Run |
| FC = Fielders Choice | SB = Stolen Base | OS = Out Stealing |

If the batter ground outs to the 2nd baseman, scoring is listed as GO, which indicates that the 2nd baseman caught the ball and threw it to the 1st baseman. If the batter flies out to the left fielder, scoring is listed FO, which signifies that the left fielder caught the ball. If the batter pop outs to the shortstop, scoring is listed PO.

The Following is an Example of Using the Scorecard

| Visiting Team | AT-BATS | HITS | RUNS | RBI'S | OUTS/HITS |
|---|---|---|---|---|---|
| Shortstop | 111 | 11 | 1 | | S-GO-D |
| Catcher | 111 | 1 | 1 | 11 | FO-PO-HR |
| 1st Baseman | 11 | 1 | | | GO-S-W |

Base Runners and Batters:

On a single, the batter advances to 1st base and all other runners advance one base.

On a double, the batter advances to 2nd base and all other runners advance two bases.

On a triple, the batter advance to 3rd base and all other runners advance three bases On a home run, the batter and runners on base advance to home plate.

Examples of Using the Outcome Portion:

| Situation | Batter rolls after swinging | Results |
|---|---|---|
| Man on 1st, 1 Out | 56 | Fly Out - RF |
| Man on 1st, 2 Out | 44 | Single 1st & 2nd* |

(*) designates that if a fast runner is now on 2nd, the runner can try to go to third. The batter would then roll the dice again and look under the Adv. Fast Runner column to see if the runner on second base advances to third.

| | | |
|---|---|---|
| Power Hitter is batting | 44 | Home Run |
| Man on $2^{nd}$ | 15 | Ground Out 2B, batter is out, runner to 3rd |

HIT/RUN

Hit/Run is a play in where the batting team has a base runner on first base. This must be called prior to pitcher rolling the dice. The pitching team rolls the dice, and if the pitch is over the plate, the batter rolls and if he hits it. The batter would then roll again and look at the HIT/RUN column. If the pitch is a ball or strike, or the batter misses the pitch, the batter must roll again to see if the base runner was successful in stealing 2nd. The batter rolls and looks under the stealing column. If the batter fouls the pitch, runner returns to first base and the pitcher rolls the dice again.

BUNTING

Bunting is a play in which the batting team tries to advance the runner(s) into scoring position. This can be called after the pitcher has rolled the dice. If the pitch is over the plate the batter can bunt. If the batter hits the ball, then look exclusively under the bunt column. If the batter tries to bunt with two strikes and fouls off the pitch, the batter is out and it is recorded as a strike out.

STEALING

Stealing is a play when a base runner tries to advance to the next base. A steal play is called before the pitcher rolls the dice, at which time the batter takes the pitch and allows the base runner to steal. If the pitcher rolls, and it is over the plate, the batter takes a strike call. The batter then rolls to see if the runner has successfully stolen the base. If two runners are on base and they both are stealing, the pitcher decides on which runner to try and throw out.

POWER HITTERS

Power Hitters are optional to use. On the outcome portion a P designates power hitters. For example, if the batter hits the ball, and then rolls a 4 and a 4, which is 44 with the bases empty, normally it would be a Single, but a power hitter hits a home run.

FAST RUNNERS

Fast runners are optional to use. For example, the fast runner is stealing 2nd and rolls a 1 and a 2 for which a normal runner would be out. However, a fast runner would be safe.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A simulated baseball game apparatus, comprising:

a game board having a baseball diamond thereon;

a scorecard having a matrix thereon, said matrix having heading indicia thereon;

a plurality of game pieces, a portion of said game pieces being colored red, a portion of said game pieces being colored white, wherein said red game pieces define fast runners and wherein said white game pieces define power hitters, wherein a batting order of said game pieces is selectable by a player to form a mix of said red game pieces representing fast runners and said white game pieces representing power hitters;

a chance means for motivating actions of said competing players, wherein said chance means provides a two digit number;

an outcome portion having means thereon for denoting plays and progress of play according to an outcome of said chance means, wherein an asterisk represents an outcome for a fast runner and a letter P represents an outcome for a power hitter.

2. A method of playing a simulated baseball game having two competing players, comprising the steps of:

providing a game board having a baseball diamond thereon;

providing a plurality of game pieces, a portion of said game pieces being colored red, a portion of said game pieces being colored white, wherein said red game pieces define fast runners and wherein said white game pieces define power hitters;

providing a chance means for motivating actions of said competing players, wherein said chance means provides a two digit number;

providing an outcome portion having means thereon for denoting plays and progress of play according to an outcome of said chance means, wherein an asterisk represents an outcome for a fast runner and a letter P represents an outcome for a power hitter;

effecting game play, wherein each player in alternating turn;

forming a batting order by selecting a mix of said game pieces from said white game pieces representing power hitters and said red game pieces representing fast runners, interspersing said white game pieces representing power hitters and said red game pieces representing fast runners in said batting order;

electing a play from among said plays available in light of the positions of said playing pieces on said game board;

utilizing said chance means to generate a movement determinant according to said outcome portion;

receiving a benefit or detriment according to said outcome portion; and winning said game by having a greater accumulation of runs at a conclusion of said simulated baseball game.

3. A method of playing a simulated baseball game having two competing players, comprising the steps of:

providing a game board having a baseball diamond thereon, said game board having scoreboard indicia thereon indicating runs scored for each inning;

providing a scorecard having a matrix thereon, said matrix having heading indicia thereon, said heading indicia including at bats, hits, runs, rbi's and outs/hits;

providing a plurality of game pieces, each of said game pieces resembling a baseball player, a portion of said game pieces being colored red, a portion of said game pieces being colored white, wherein said red game pieces define fast runners and wherein said white game pieces define power hitters;

providing a chance means for motivating actions of said competing players, wherein said chance means provides a two digit number;

providing an outcome portion having means thereon for denoting plays and progress of play according to an outcome of said chance means, wherein an asterisk represents an outcome for a fast runner and a letter P represents an outcome for a power hitter;

effecting game play, Wherein each player in alternating turn;

forming a batting order by selecting a mix of said game pieces from said white game pieces representing power hitters and said red game pieces representing fast runners, interspersing said white game pieces representing power hitters and said red game pieces representing fast runners in said batting order;

electing a play from among said plays available in light of the positions of said playing pieces on said game board;

utilizing said chance means to generate a movement determinant according to said outcome portion;

receiving a benefit or detriment according to said outcome portion; and winning said game by having a greater accumulation of runs at a conclusion of said simulated baseball game.

* * * * *